US008994541B2

(12) United States Patent
Fisera et al.

(10) Patent No.: US 8,994,541 B2
(45) Date of Patent: Mar. 31, 2015

(54) MONITORING CONDENSER PERFORMANCE

(71) Applicant: Honeywell International Inc., Morristown, NJ (US)

(72) Inventors: Radek Fisera, Mnichovice (CZ); Martin Strelec, Chodov (CZ)

(73) Assignee: Honeywell International Inc., Morristown, NJ (US)

( * ) Notice: Subject to any disclaimer, the term of this patent is extended or adjusted under 35 U.S.C. 154(b) by 136 days.

(21) Appl. No.: 13/682,387

(22) Filed: Nov. 20, 2012

(65) Prior Publication Data

US 2014/0139343 A1 May 22, 2014

(51) Int. Cl.
*G08B 21/00* (2006.01)
*G08B 21/18* (2006.01)

(52) U.S. Cl.
CPC ..... *G08B 21/185* (2013.01)
USPC ..... 340/635; 340/540; 340/585; 340/522; 62/129

(58) Field of Classification Search
CPC ..... G08B 21/185; F25B 49/02; F25B 1/00; F25B 2500/19; F25B 2600/111; F25B 2700/1931; F25B 2700/21152
USPC ..... 340/635, 614, 612, 603, 540, 618, 585, 340/588, 522, 607, 622, 647; 62/115, 157, 62/129, 121, 171; 702/183
See application file for complete search history.

(56) References Cited

U.S. PATENT DOCUMENTS

| | | | | |
|---|---|---|---|---|
| 7,752,854 | B2 * | 7/2010 | Singh et al. | 62/129 |
| 2012/0280816 | A1 * | 11/2012 | Gado et al. | 340/614 |
| 2013/0186119 | A1 * | 7/2013 | Burns et al. | 62/115 |

* cited by examiner

*Primary Examiner* — Anh V La
(74) *Attorney, Agent, or Firm* — Brooks, Cameron & Huebsch, PLLC

(57) ABSTRACT

Methods, apparatuses, and systems for monitoring condenser performance are described herein. One method includes receiving a control signal associated with a fan component of a condenser of a refrigeration system, determining an expected control signal based on a number of driving conditions associated with the condenser, and providing a notification responsive to a difference between the received control signal and the expected control signal exceeding a threshold.

19 Claims, 2 Drawing Sheets

MONITORING CONDENSER PERFORMANCE

TECHNICAL FIELD

The present disclosure relates to methods apparatuses, and systems for monitoring condenser performance.

BACKGROUND

Refrigeration systems may include a number of condensers (e.g., condensing units, condensing components, etc.). In some refrigeration systems (e.g., large and/or commercial systems), condensers may be air cooled and may have an associated control loop to control fan speed, for instance. Such systems may be located outside structures (e.g., on the roof of a structure) and therefore may be exposed to various (e.g., potentially damaging) environmental conditions. Such conditions may decrease performance (e.g., efficiency) of refrigeration systems.

For example, heat transfer efficiency of condensers may be reduced by one or more obstruction anomalies (e.g., leaves, plastic bags, bird carcasses, etc.) and/or by degradation (e.g., dust, particle deposition, etc.), among other causes of condenser fouling. Such fouling may cause condenser fan(s) to produce increased head pressure (e.g., via an increase in rotational speed) to deliver airflow and remove heat from refrigerant(s). As a result, fans may consume more power at the price of increased monetary cost, for instance.

Previous approaches to monitoring performance may include measuring energy usage of refrigeration systems. These approaches may be ineffective at determining root cause(s) of condenser inefficiency, because, for example, energy meters under such approaches may be installed elsewhere in refrigeration systems (e.g., in compressor racks). To maintain performance and/or efficiency, refrigeration system maintenance actions can be performed on a scheduled basis, though such actions may be unnecessary, time-consuming, and/or otherwise cost-ineffective.

BRIEF DESCRIPTION OF HE DRAWINGS

DETAILED DESCRIPTION

Figure 1:
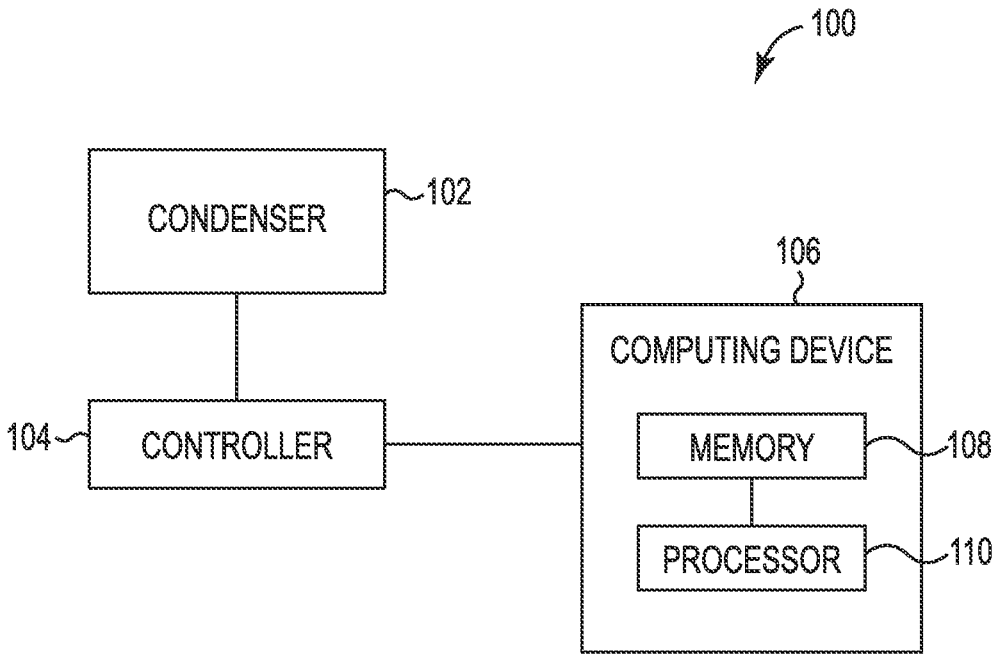
FIG. 1 illustrates a system for monitoring condenser performance in accordance with one or more embodiments of the present disclosure.

Methods, apparatuses, and systems for monitoring condenser performance are described herein. For example, one or more embodiments include receiving a control signal associated with a fan component of a condenser of a refrigeration system, determining an expected control signal based on a number of driving conditions associated with the condenser, and providing a notification responsive to a difference between the received control signal and the expected control signal exceeding a threshold.

Various embodiments of the present disclosure can monitor (e.g., continuously monitor) performance of a condenser (e.g., condensing unit(s), condensing component(s), etc.). Accordingly, embodiments of the present disclosure can determine (e.g., sense and/or detect) decreases in heat transfer efficiency of condensers.

Changes in heat transfer efficiency can include decreases (e.g., rapid decreases) resulting from one or more obstruction anomalies. Obstruction anomalies, as referred to generally herein, can refer to foreign bodies in an inlet of an air-cooled condenser and can include bodies such as leaves, plastic bags, and/or bird carcasses, for instance, among various others.

Changes in heat transfer efficiency can include decreases (e.g., gradual decreases) resulting from degradation. Degradation, as referred to generally herein, can refer to decreases in heat transfer efficiency caused by build up of various particles such as dust, for instance, on component(s) of condensers.

Embodiments of the present disclosure can statistically model a fan control signal of a condenser based on various driving conditions. Embodiments of the present disclosure can model a plurality of control signals associated with a respective plurality of fans and/or determine a mean fan control signal associated with the plurality of fan control signals and determine models based on driving conditions at various times (e.g., time instances).

Driving conditions, as referred to generally herein, include conditions (e.g., variables) having a capability to vary (e.g., influence) a fan control signal. For example, driving conditions can include temperature (e.g., outside and/or ambient'temperature), humidity, discharge pressure, refrigerant properties, controller signal, and/or split valve control signal, among other conditions. Such conditions can be determined using various sensing devices and can be communicated to controller(s) and/or computing device(s), for instance. (discussed further below). Sensing devices can include temperature sensors, humidity sensors, pressure sensors, etc.

Embodiments of the present disclosure can receive and/or determine a particular set of driving conditions at (or over) a particular time and, based on such conditions, can determine an expected fan control signal (e.g., using a historical relationship between the particular set of driving conditions and the fan control signal). In various embodiments, the expected fan control signal can be compared with a received (e.g., current and/or actual) fan control signal at (or over) the particular time. A particular (e.g., threshold-exceeding) difference between the expected fan control signal and the received fan control signal may be indicative of condenser fouling, for instance. Various actions can be taken in the event of such a determined difference, such as the provision of a notification, for instance.

Embodiments can include the creation of various models associated with relationship(s) between driving conditions and fan control signals, because, for instance, dependency of a fan control signal on various driving conditions may be non-linear. For example, some embodiments can include the creation of a global nonlinear model. Such a model may be based on extended time periods (e.g., a season, a year, etc.). A global non-linear model may be useful, for instance, in determining degradation, though embodiments of the present disclosure do not limit the use of such a model for specific determinations.

Some embodiments can include the creation of a local polynomial regression model. Such a model can be created at a particular instant based on a particular set of driving conditions substantially similar to the driving conditions at that instant. A local polynomial regression model may be useful, for instance, in determining obstruction anomalies, though embodiments of the present disclosure do not limit the use of such a model for specific determinations. Additionally, though some models are named and/or discussed herein, embodiments of the present disclosure are not limited to such named and/or discussed models.

In the following detailed description, reference is made to the accompanying drawings that form a part hereof. The drawings show by way of illustration how one or more embodiments of the disclosure may be practiced.

These embodiments are described in sufficient detail to enable those of ordinary skill in the art to practice one or more embodiments of this disclosure. It is to be understood that other embodiments may be utilized and that process changes may be made without departing from the scope of the present disclosure.

As will be appreciated, elements shown in the various embodiments herein can be added, exchanged, combined, and/or eliminated so as to provide a number of additional embodiments of the present disclosure. The proportion and the relative scale of the elements provided in the figures are intended to illustrate the embodiments of the present disclosure, and should not be taken in a limiting sense.

The figures herein follow a numbering convention in which the first digit or digits correspond to the drawing figure number and the remaining digits identify an element or component in the drawing. Similar elements or components between different figures may be identified by the use of similar digits.

As used herein, "a" or "a number of something can refer to one or more such things. For example, number of blocks" can refer to one or more blocks.

FIG. 1 illustrates a system 100 for monitoring condenser performance in accordance with one or more embodiments of the present disclosure. As shown in FIG. 1, system 100 includes a condenser 102, a controller 104 associated with condenser 102, and a computing device 106.

Condenser 102 can refer to a single condenser and/or a plurality of condensers. Though not specifically illustrated in FIG. 1, condenser 102 can include various components including a number of fans and/or a number of coils, for instance, among others.

Controller 104 can be an embedded controller associated with a refrigeration system and/or a portion of a refrigeration system (e.g., condenser 102). Controller 104 can receive (e.g., acquire) data from condenser 102 such as, for example, fan control signals and/or various driving conditions. Further controller 104 can include a processor configured to execute instructions associated with controlling condenser 102 (e.g., in a manner analogous to processor 110 discussed below).

Computing device 106 can be various types of computing devices, and embodiments of the present disclosure are not limited to particular types of computing devices. As shown in FIG. 1, computing device 106 includes a memory 108 and a processor 110 coupled to memory 108. Memory 108 can be any type of storage medium that can be accessed by processor 110 to perform various examples of the present disclosure. For example, memory 108 can be a non-transitory computer readable medium having computer readable instructions (e.g., computer program instructions) stored thereon that are executable by processor 110 to monitor performance of condenser 102 in accordance with one or more embodiments of the present disclosure.

Memory 108 can be volatile or nonvolatile memory. Memory 108 can also be removable (e.g., portable) memory, or non-removable (e.g., internal) memory. For example, memory 108 can be random access memory (RAM) (e.g., dynamic random access memory (DRAM) and/or phase change random access memory (PCRAM)), read-only memory (ROM) (e.g., electrically erasable programmable read-only memory (EEPROM) and/or compact-disc read-only memory (CD-ROM)), flash memory, a laser disc, a digital versatile disc (DVD) or other optical disk storage, and/or a magnetic medium such as magnetic cassettes, tapes, or disks, among other types of memory.

Further, although memory 108 is illustrated as being located in computing device 106, embodiments of the present disclosure are not so limited. For example, memory 108 can also be located internal to another computing resource (e.g., enabling computer readable instructions to be downloaded over the Internet or another wired or wireless connection).

Controller 104 can interact with computing device 106 via a communicative coupling. A communicative coupling can include wired and/or wireless networks allowing communication in any direction between controller 104 and computing device 106.

As previously discussed, controller 104 can receive and/or determine a control signal associated with a fan component of condenser 102 while condenser 102 is operating. Additionally, controller 104 can determine a plurality of driving conditions associated with condenser 104 while condenser 104 is operating. Such determination can be carried out according to a schedule (e.g., periodically) and/or continuously, for instance.

In various embodiments, controller 104 can communicate the control signal and/or the driving conditions to computing device 106. Such communication can be carried out according to a schedule (e.g., periodically) and/or continuously, for instance, For example, driving conditions can be communicated by controller 104 to computing device 106 responsive and/or subsequent to their determination.

In various embodiments, computing device 106 can receive the control signal and the driving conditions over a particular (e.g., first) period of time (e.g., a summer, a year, 5 months, etc.) and determine a number of historical relationships (e.g., models) between the control signal and the driving conditions (e.g., a portion of the driving conditions). Such models may be referred to as "global nonlinear models." For example, such models can map values of the control signal with respect to changes in one or more of the driving conditions (e.g., change in fan control signal based on incremental changes in ambient temperature and/or humidity).

In such embodiments, the models, once determined by computing device 106, can be communicated back to controller 104, for instance, and/or stored therein. Controller 104 can receive a number of the driving conditions over a subsequent (e.g., second) and/or current period of time from condenser 102, Controller 104 can evaluate (e.g., compare) the current driving conditions against one or more of the models received from computing device 106 to determine an expected fan control signal based on the current driving conditions. Controller 104 can compare the current fan signal with an expected fan control signal based on current driving conditions. An expected fan control signal can be determined based on one or more of the models received from computing device 106.

In such embodiments, controller 104 can receive the fan control signal over the subsequent (e.g., second) and/or current period of time from condenser 102. Controller 104 can compare the current fan control signal with the expected fan control signal to determine a relationship, deviation, and/or difference between the signals. If controller 104 determines that the difference exceeds a particular threshold (e.g., current fan control signal is particularly elevated with respect to expected fan control signal), controller 104 can determine that a fouling (e.g., obstruction anomaly and/or degradation) of condenser 102 has occurred and/or take a number of various actions.

For example, controller 104 can deactivate (e.g., shut down) condenser 102, provide a notification (e.g., to computing device 106 and/or a user of computing device 106) associated with the determined fouling, and/or recommend a maintenance action on the condenser, among other actions. Notifications can include determinations associated with a type of fouling. For instance, an obstruction anomaly may be indicated by a rapid change in the relationship between the expected control signal and the current control signal, whereas degradation may be indicated by a substantially gradual change.

In such embodiments, models can be determined, created, and/or received on an infrequent (e.g., seasonally or yearly) basis. Thus, such embodiments may provide cost savings associated with maintaining constant communications between controller 104 and computing device 106, for instance. Such savings may come at decreased levels of accuracy, for instance, with shorter periods of driving condition measurement.

Other embodiments can include increased levels of regular communication between controller 104 and computing device 106. Such embodiments can include aspects previously discussed; for example, in a manner analogous to that previously discussed, controller 104 can communicate the control signal and/or the driving conditions to computing device 106, and computing device 106 can receive the control signal and the driving conditions over a particular (e.g., first) period of time (e.g., a summer, a year, 5 months, etc.) and determine a number of historical relationships (e.g., models) between the control signal and the driving conditions (e.g., a portion of the driving conditions). For example, such models can map values of the control signal with respect to changes in one or more of the driving conditions (e.g., change in fan control signal based on incremental changes in ambient temperature and/or humidity).

Whereas, in embodiments such as those previously discussed, computing device 106 communicates the determined models to controller 104, in some embodiments computing device 106 can retain the models and can receive the current driving conditions from controller 104. Computing device 106 can evaluate the current driving conditions against the model(s) to determine an expected fan control signal based on the current (e.g., instantaneous) driving conditions. Computing device 106 can build various models based on historical driving conditions substantially similar to current driving conditions. Computing device 106 can determine and expected fan control signal based on current driving conditions.

Computing device 106 can receive the fan control signal over the subsequent (e.g., second) and/or current period of time from controller 104 and can compare the current fan control signal with the expected fan control signal to determine a relationship and/or difference between the signals. If computing device 106 determines that the difference exceeds a particular threshold (e.g., current fan control signal is particularly elevated with respect to expected fan control signal), computing device 106 can determine that a fouling (e.g. degradation) of condenser 102 has occurred and/or take a number of various actions. For example, computing device 106 can instruct controller 104 to shut down condenser 102 and/or provide a notification associated with the determined fouling. In such embodiments (e.g., using local polynomial regression model(s)), models can be created locally for each particular set of driving conditions (e.g., on-the-fly).

Such embodiments can manage a non-linear relationship between driving condition(s) and fan control signal(s) by local linear modeling (e.g., linear in coefficients). Particular driving conditions can be transformed by specific non-linear functions (e.g., derived empirically and/or using expert knowledge). Such transformed driving condition(s) can be used as additional regressor(s) of local model(s).

Figure 2:
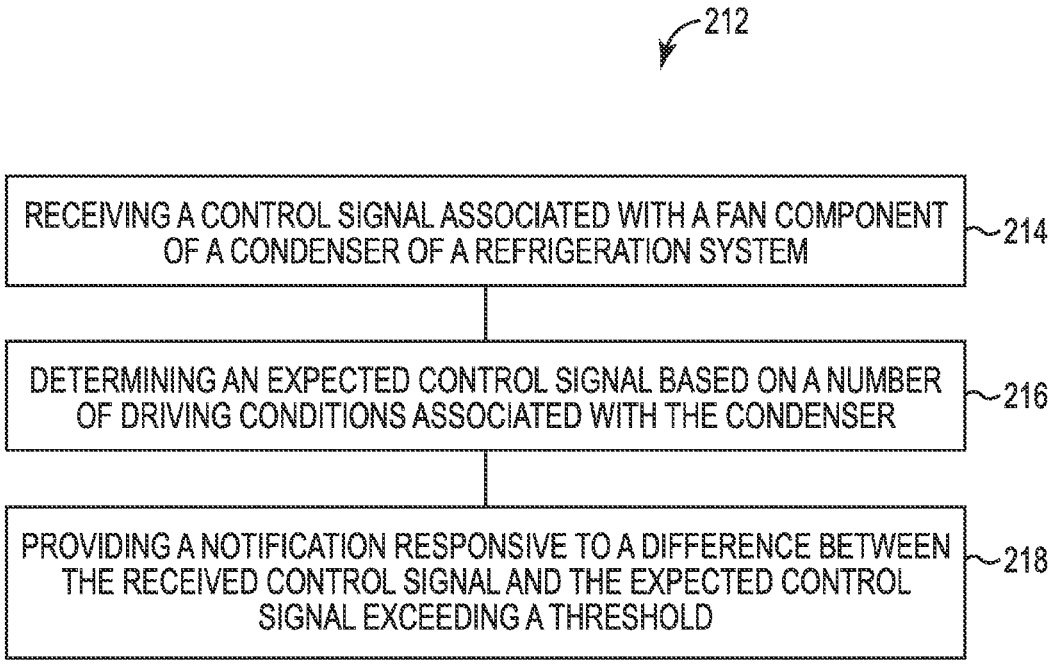
FIG. 2 illustrates a method for monitoring condenser performance in accordance with one or more embodiments of the present disclosure.

FIG. 2 illustrates a method 212 for monitoring condenser performance in accordance with one or more embodiments of the present disclosure. Method 212 can be performed, for example, by a computing device, such as computing device 106 described above (e.g., in connection with FIG. 1). For example, computing device 106 can execute instructions (e.g., stored in memory 108) to perform method 212.

At block 214, method 212 includes receiving a control signal associated with a fan component of a condenser. Control signal(s) can be received in a manner analogous to that previously discussed, for instance.

At block 216, method 212 includes determining an expected control signal based on a number of driving conditions associated with the condenser. Driving conditions can include driving conditions previously received and/or stored in a database (e.g., historical driving conditions). An expected control signal can include a control signal estimated based on a known (e g., measured) relationship between the previously-received driving conditions and an associated control signal (e.g., determined over the same time period).

At block 218, method 212 includes providing a notification responsive to a difference between the received control signal and the expected control signal exceeding a threshold. Differences (e.g., deviations) can be determined in a manner analogous to that previously discussed, for instances, and notifications can be provided responsive to differences that exceed particular thresholds, as previously discussed.

Although specific embodiments have been illustrated and described herein, those of ordinary skill in the art will appreciate that any arrangement calculated to achieve the same techniques can be substituted for the specific embodiments shown. This disclosure is intended to cover any and all adaptations or variations of various embodiments of the disclosure.

It is to be understood that the above description has been made in an illustrative fashion, and not a restrictive one. Combination of the above embodiments, and other embodiments not specifically described herein will be apparent to those of skill in the art upon reviewing the above description.

The scope of the various embodiments of the disclosure includes any other applications in which the above structures and methods are used. Therefore, the scope of various embodiments of the disclosure should be determined with reference to the appended claims, along with the full range of equivalents to which such claims are entitled.

In the foregoing Detailed Description, various features are grouped together in example embodiments illustrated in the figures for the purpose of streamlining the disclosure. This method of disclosure is not to be interpreted as reflecting an intention that the embodiments of the disclosure require more features than are expressly recited in each claim.

Rather, as the following claims reflect, inventive subject matter lies in less than all features of a single disclosed embodiment. Thus, the following claims are hereby incorporated into the Detailed Description, with each claim standing on its own as a separate embodiment.

What is claimed:

1. A method for monitoring an operation of a condenser, comprising:

receiving a control signal associated with a fan component of a condenser of a refrigeration system;

determining an expected control signal based on a number of driving conditions associated with the condenser;

determining a type of condenser fouling based on a rate of change in the difference between the received control signal and the expected control signal; and providing a notification responsive to a difference between the received control signal and the expected control signal exceeding a threshold.

2. The method of claim 1, wherein the method includes receiving the control signal from an embedded controller associated with the condenser.

3. The method of claim 1, wherein the number of driving conditions includes an outdoor temperature.

4. The method of claim 1 wherein the number of driving conditions includes a discharge pressure associated with the condenser.

5. The method of claim 1, wherein the method includes:

receiving the control signal over a first period of time;

receiving the number of driving conditions over the first period of time;

determining a historical relationship between the control signal and a portion of the driving conditions;

receiving the control signal over a second period of time;

receiving the number of driving conditions over the second period of time;

determining a particular deviation from the relationship during the second period of time; and providing the notification responsive to the determination of the particular deviation.

6. The method of claim 5, wherein the first period of time is a season of a year.

7. The method of claim 5, wherein the second period of time is an instantaneous time.

8. An apparatus for monitoring a performance of a condenser, comprising:

a controller associated with a condenser of a refrigeration system, configured to:

receive a model associated with an expected relationship between a control signal associated with a fan of a condenser and a plurality of driving conditions associated with the condenser;

monitor a relationship between the control signal and the driving conditions while the condenser is operating;

determine a type of condenser fouling based on a rate of change in the difference between the monitored relationship and the expected relationship; and take an action responsive to a difference between the monitored relationship and the expected relationship exceeding a threshold.

9. The apparatus of claim 8, wherein the controller is configured to receive a polynomial regression model.

10. The apparatus of claim 8, wherein the controller is configured to receive a nonlinear model.

11. The apparatus of claim 8, wherein the controller is configured to determine the expected relationship based on a historical relationship between the control signal and a portion of the plurality of driving conditions.

12. The apparatus of claim 8, wherein the plurality of driving conditions includes a split valve signal and humidity.

13. The apparatus of claim 8, wherein the controller is configured to recommend a maintenance action associated with the condenser responsive to the difference exceeding the threshold.

14. The apparatus of claim 8, wherein the controller is configured to provide a notification to a computing device responsive to the difference exceeding the threshold.

15. The apparatus of claim 8, wherein the controller is configured to receive the model at a particular interval.

16. A system for monitoring a performance of a condenser, comprising:

a controller associated with a condenser of a refrigeration system, configured to:

monitor a control signal associated with a fan component of the condenser while the condenser is operating: and monitor a plurality of driving conditions associated with the condenser while the condenser is operating; and a computing device, configured to:

receive the monitored control signal and the monitored plurality of driving conditions;

create a historical model corresponding to a relationship between the monitored control signal and the monitored plurality of driving conditions;

determine an expected control signal based on the historical model and a particular set of driving conditions associated with a particular instance;

determine a type of condenser fouling based on a rate of change in the difference between the received monitored control signal and the expected control signal; and issue a notification responsive to a difference between the received monitored control signal and the expected control signal exceeding a particular threshold.

17. The system of claim 16, wherein the controller is configured to monitor the plurality of driving conditions using a plurality of sensing device.

18. The system of claim 17, wherein the notification includes a notification of an obstruction anomaly associated with the condenser.

19. The system of claim 17, wherein the notification includes a notification of a degradation associated with the condenser.

* * * * *